US008083073B1

(12) United States Patent
Brown

(10) Patent No.: US 8,083,073 B1
(45) Date of Patent: Dec. 27, 2011

(54) LOADER BUCKET SIEVE APPARATUS

(76) Inventor: Paul Brown, Seaford (AU)

( * ) Notice: Subject to any disclaimer, the term of this patent is extended or adjusted under 35 U.S.C. 154(b) by 0 days.

(21) Appl. No.: 12/955,260

(22) Filed: Nov. 29, 2010

(51) Int. Cl.
*B07B 1/49* (2006.01)

(52) U.S. Cl. ..... 209/421; 209/38; 209/233; 209/420; 37/405; 37/406; 37/411

(58) Field of Classification Search ..... 209/420, 209/421; 171/46; 187/236; 37/409, 411, 37/412, 444, 450, 901; 280/79.5
See application file for complete search history.

(56) References Cited

U.S. PATENT DOCUMENTS 5,160,034 A * 11/1992 Potter ..... 209/38
5,940,996 A * 8/1999 Cummings ..... 37/409
6,059,119 A * 5/2000 Davis ..... 209/233
6,092,606 A * 7/2000 Basler ..... 171/63
6,718,662 B1 * 4/2004 Schaff ..... 37/405
6,820,357 B1 11/2004 Menard et al.
6,988,866 B2 1/2006 Friedland et al.
7,066,275 B1 * 6/2006 Keigley ..... 171/63
7,631,446 B1 * 12/2009 Davis ..... 37/444
7,641,436 B2 1/2010 Wippel et al.
2009/0282710 A1 * 11/2009 Johnson ..... 37/406
* cited by examiner

*Primary Examiner* — Terrell Matthews
(74) *Attorney, Agent, or Firm* — Crossley Patent Law; Mark A. Crossley

(57) ABSTRACT

The loader bucket sieve apparatus is clamped between the jaws of the bucket of a bucket loader or the like, without tools or fasteners. Importantly, as the apparatus rests upon a given surface, the loader operator need only place the jaws of the bucket in the appropriate positions and then clamp the jaws together, reversing said procedure when wishing to disengage the apparatus. The apparatus may have straight supports or concave supports, depending upon need and bucket application. The sieves may extend beyond each side of the supports at each side of the apparatus in order to increase work surface beyond the bounds of the jaws. The sieves may be equidistantly spaced and may also be unequally spaced apart. Sieves may be disposed within all the holes or part of the holes of the supports.

3 Claims, 4 Drawing Sheets

LOADER BUCKET SIEVE APPARATUS

BACKGROUND OF THE INVENTION

The buckets of various loaders, such as front loaders and other heavy equipment for example, are useful for a variety of work tasks. One applicable need is that of having an ability to move limbs, rocks, debris, and other materials without necessarily transferring smaller material, such as dirt for example. There is also the typical need of increasing the load carrying capacity of buckets. Various devices have been proposed for such tasks. Virtually all such devices require some form of fastening to the buckets wherein tools and fasteners must be used and even holes drilled. Therefore, such devices are not easily applied or removed. Such devices typically fasten to some part of a bucket or some part of the jaws of a dual jaw bucket. The present apparatus solves these problems.

FIELD OF THE INVENTION

The loader bucket sieve apparatus relates to bucket loaders and more especially to a sieve apparatus that is selectively held between the jaws of a bucket loader and requires no attachment.

SUMMARY OF THE INVENTION

The general purpose of the loader bucket sieve apparatus, described subsequently in greater detail, is to provide a loader bucket sieve apparatus which has many novel features that result in an improved loader bucket sieve apparatus which is not anticipated, rendered obvious, suggested, or even implied by prior art, either alone or in combination thereof.

To attain this, the loader bucket sieve apparatus is clamped between the jaws of the bucket of a bucket loader or the like, without tools or fasteners. Importantly, as the apparatus rests upon a given surface, the loader operator need only place the jaws of the bucket in the appropriate positions and then clamp the jaws together, reversing said procedure when wishing to disengage the apparatus. The apparatus may have straight supports or concave supports, depending upon need and bucket application. The sieves may extend beyond each side of the supports at each side of the apparatus in order to increase work surface beyond the bounds of the jaws.

The sieves may be equidistantly spaced and may also be unequally spaced apart. Sieves may be disposed within all the holes or part of the holes of the supports.

Thus has been broadly outlined the more important features of the improved loader bucket sieve apparatus so that the detailed description thereof that follows may be better understood and in order that the present contribution to the art may be better appreciated.

An object of the loader bucket sieve apparatus is to provide a sieve for a bucket of a loader.

Another object of the loader bucket sieve apparatus is to provide easy application and removal from the jaws of a bucket.

A further object of the loader bucket sieve apparatus is to negate the use of tools and fasteners in the application of the apparatus to a bucket.

An added object of the loader bucket sieve apparatus is to increase the carrying capacity of a bucket of a loader.

And, an object of the loader bucket sieve apparatus is to ease work site materials handling tasks.

These together with additional objects, features and advantages of the improved loader bucket sieve apparatus will be readily apparent to those of ordinary skill in the art upon reading the following detailed description of presently preferred, but nonetheless illustrative, embodiments of the improved loader bucket sieve apparatus when taken in conjunction with the accompanying drawings.

DETAILED DESCRIPTION OF THE DRAWINGS

With reference now to the drawings, and in particular FIGS. 1 through 6 thereof, the principles and concepts of the loader bucket sieve apparatus generally designated by the reference number 10 will be described.

Figure 1:
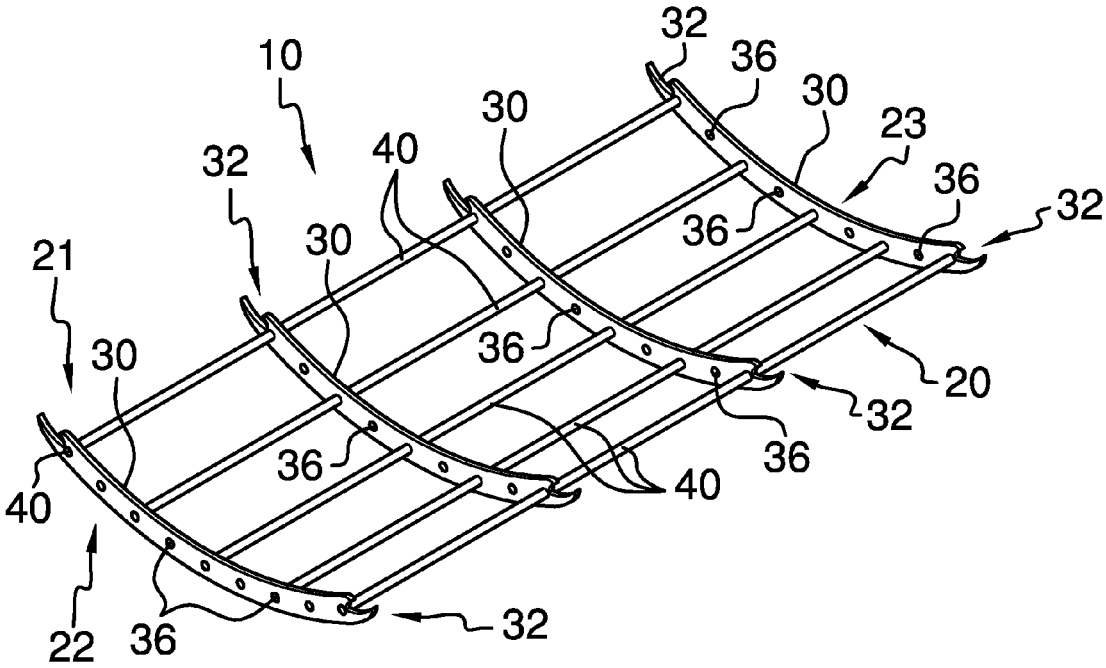
FIG. 1 is a perspective view of the concave support apparatus.

Referring to FIG. 1, the apparatus 10 comprises the front 20 spaced apart from the rear 21 and the first side 22 spaced apart from the second side 23. The plurality of spaced apart supports 30 is provided. One of the supports 30 is disposed at the first side 22. One of the supports 30 is disposed at the second side 23.

At least two supports 30 are disposed between the first side 22 and the second side 23. The supports 30 are extended from proximal to the front 20 to proximal to the rear 21.

Figure 2:
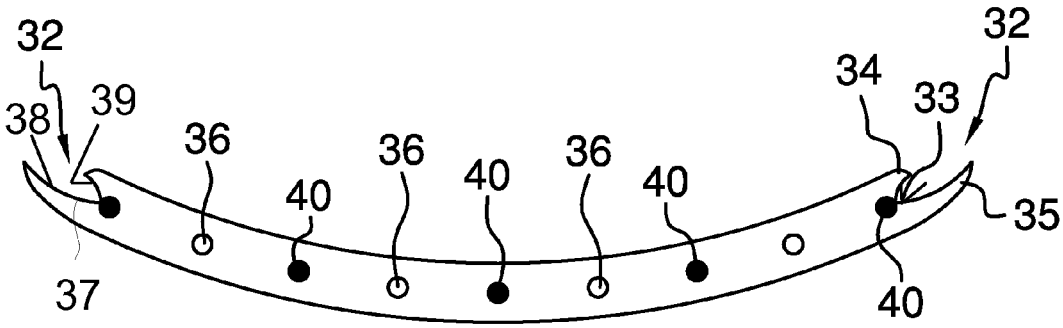
FIG. 2 is a lateral elevation view of FIG. 1.
Figure 3:
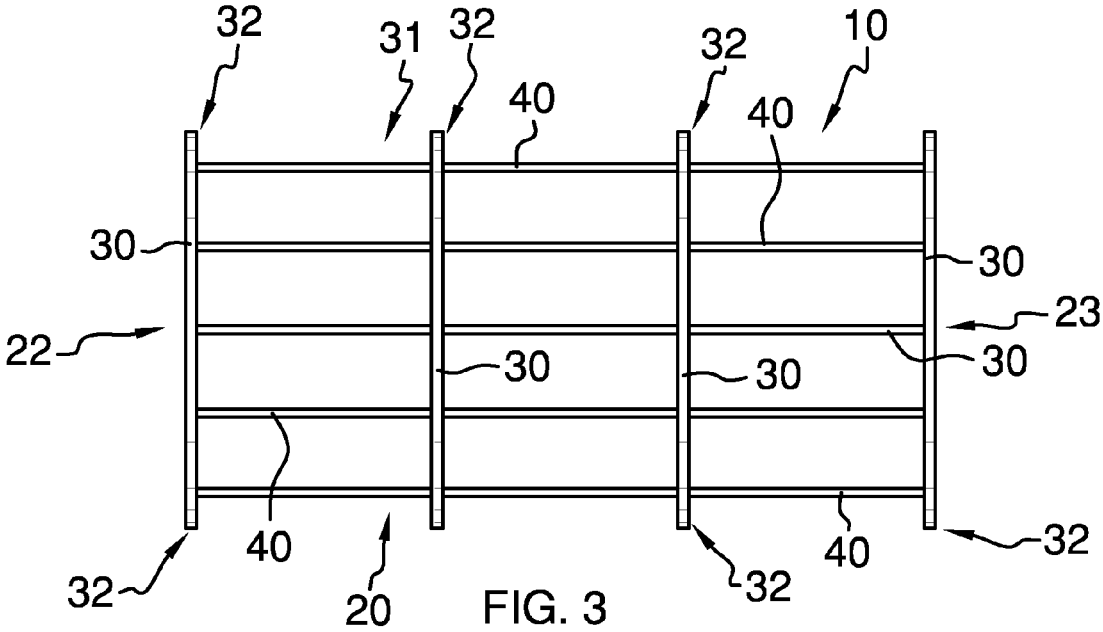
FIG. 3 is a top plan view.

Referring to FIG. 2, each support 30 further comprises a plurality of equidistantly spaced apart holes 36. A claw-shaped connection 32 is disposed on a support 30 proximal to the front 20 and on a support 30 proximal to the rear 21, and each connection 32 has a inside edge 37. A well 33 is disposed along the inside edge 37 of each connection 32 and has an elongated concave first portion 38 and a concave second portion 39 having a length shorter than a length of the first portion 38. The second portion 39 faces the first portion 38. A pair of extensions is disposed on each connection 32. A slightly downwardly curved upper extension 34 is disposed above the well 33. A longer slightly curved lower extension 35 is disposed below the well 33.

Referring to FIG. 3 and again to FIG. 2, the plurality of sieves 40 is provided. The sieves 40 are disposed within at least some of the holes 36 of the supports 30. As illustrated, the sieves 40 are disposed within every other hole 36 of the supports 30, with one sieve 40 disposed adjacent to the front 20 and one sieve 40 disposed adjacent to the rear 21.

Figure 4A:
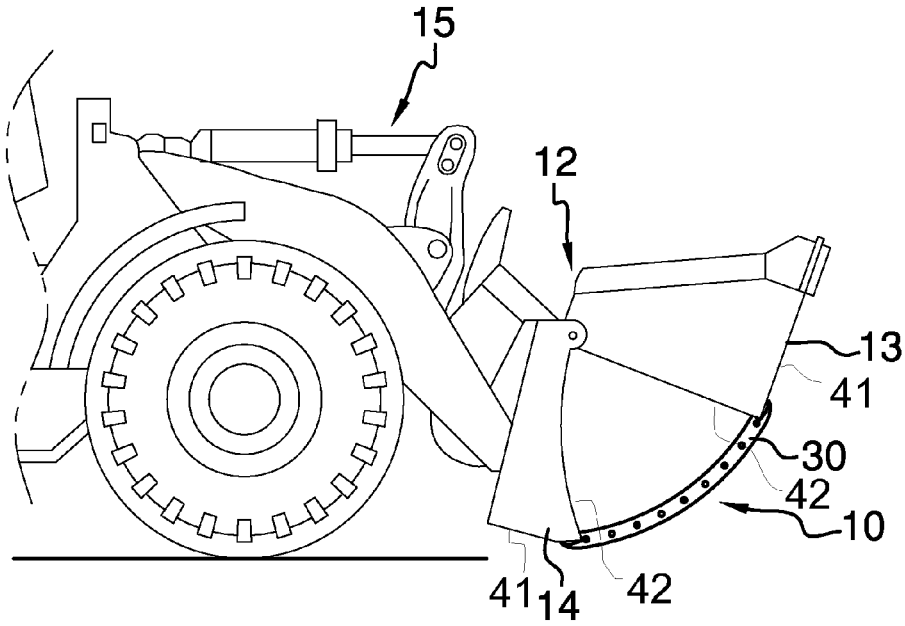
FIG. 4A is a lateral elevation view of the concave support apparatus installed between the fore and aft jaws of a bucket of a loader.
Figure 5:
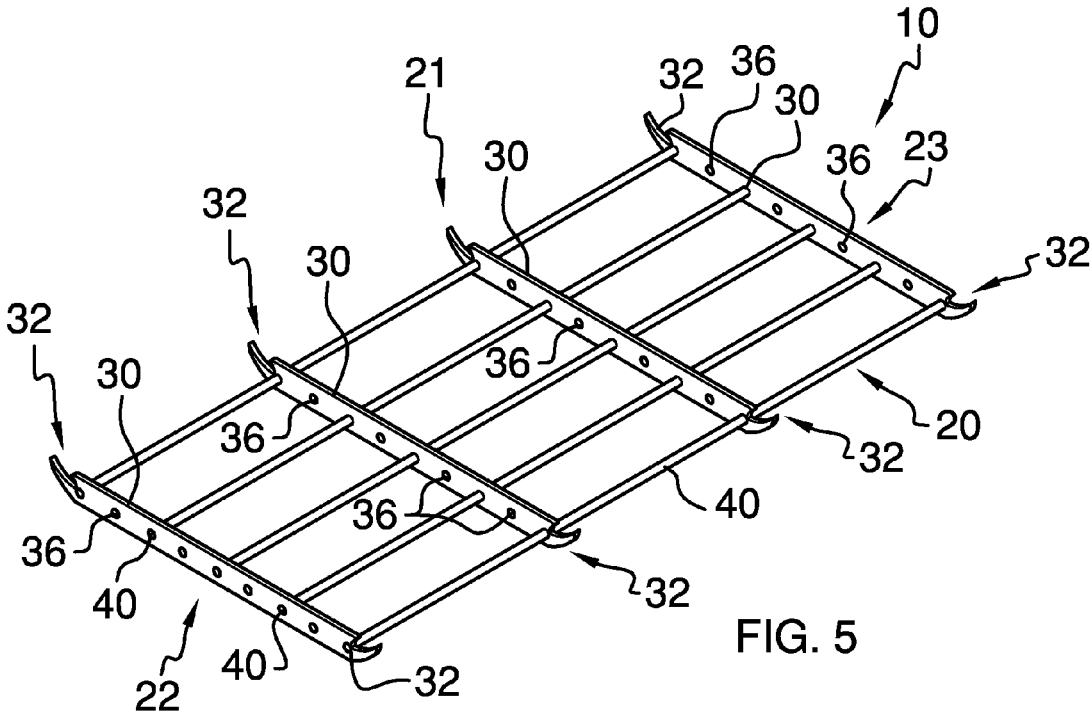
FIG. 5 is a perspective view of the straight apparatus.

Referring to FIG. 5, the apparatus 10 is provided with straight rather than concave supports 30. All other features of the apparatus 10 are identical to those illustrated in FIGS. 1, 2, and 4A.

Figure 4:
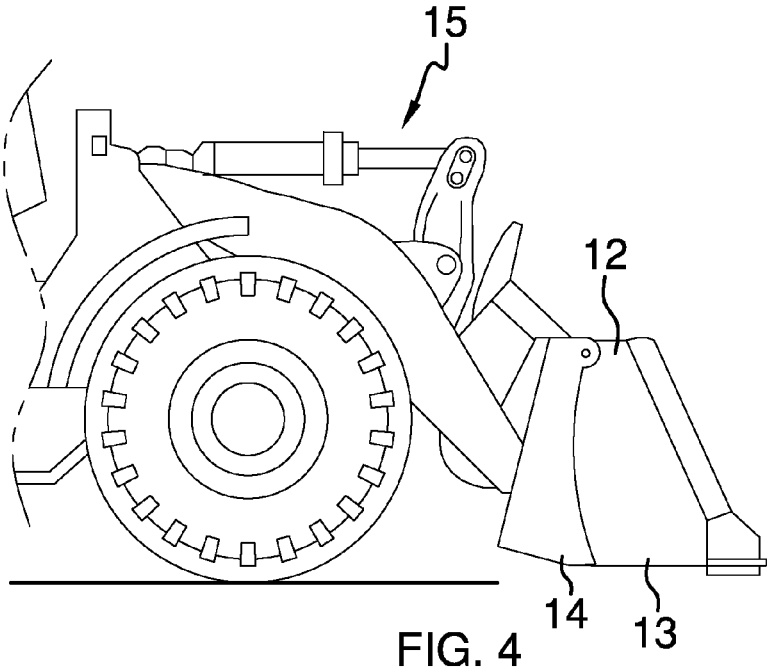
FIG. 4 is a lateral elevation view of an existing loader with bucket.

Referring to FIG. 4, an existing loader 15 is illustrated. The loader 15 has a bucket 12 with a fore jaw 13 that can be separated from an aft jaw 14.

Referring to FIG. 4A, the fore jaw 13 and aft jaw 14 of the bucket 12 are separated. Each connection 32 is selectively held between the fore jaw 13 and the aft jaw 14 of the bucket 12 by the engagement of the jaws with the connections 32 of the apparatus 10. Each connection 32 disposed on one of the supports 30 proximal to the front 20 and to the rear 21 is removably attached to the respective loader 15 bucket 12 fore jaw 13 and the loader 15 bucket 12 aft jaw 14. The well 33 first portion 38 and the well second portion 39 of each connection 32 are removably attached to an exterior edge 41 and an interior edge 42, respectively, of the respective aft jaw 14 and fore jaw 13. The jaws are simply squeezed together to form the engagement with the apparatus 10 without tools and without fasteners.

Figure 6:
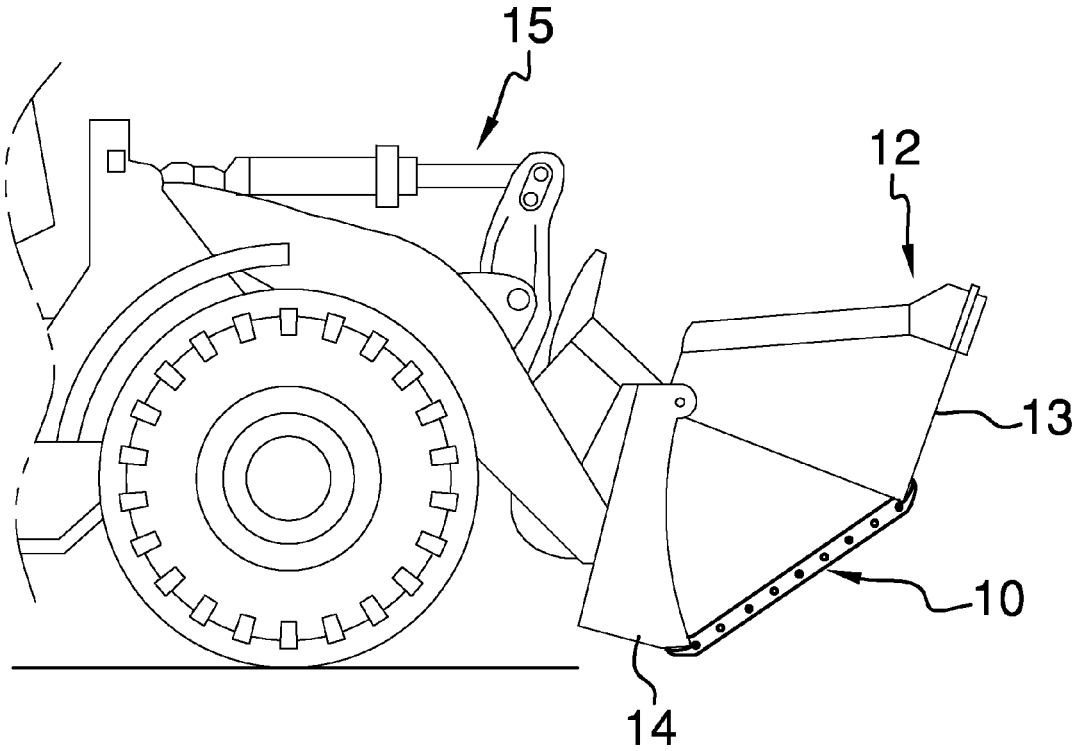
FIG. 6 is a view of the straight support apparatus, installed between the fore and aft jaws of the bucket of a loader.

Referring to FIG. 6, the straight support 30 apparatus 10 is clenched between the jaws of the bucket 12.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the loader bucket sieve apparatus may be used.

What is claimed is:

1. A loader bucket sieve apparatus comprising, in combination:

a front spaced apart from a rear, a first side spaced apart from a second side;

a plurality of spaced apart supports, one support disposed at the first side, one support disposed at the second side, at least two additional supports disposed between the first side and the second side, the supports extended from proximal to the front to proximal to the rear, each support further comprising:

a plurality of equidistantly spaced apart holes;

a claw-shaped connection disposed at the front of each support and a connection disposed at the rear of each support, each connection having an inside edge;

a well disposed along the inside edge of each connection, the well having an elongated concave first portion and a concave second portion having a length shorter than a length of the first portion, wherein the second portion faces the first portion;

a pair of extensions disposed on each connection, a slightly downwardly curved upper extension disposed above the well, a longer slightly curved lower extension disposed below the well;

a plurality of sieves, the sieves disposed within at least some of the holes of the supports;

whereby is selectively held between a fore jaw and an aft jaw of a bucket of an existing loader; and wherein each connection disposed on one of the supports proximal to the front and to the rear is removably attached to the loader bucket fore jaw and the loader bucket aft jaw, respectively;

wherein the well first portion and the well second portion of each connection are removably attached to an exterior edge and an interior edge, respectively, of the respective aft jaw and fore jaw.

2. The apparatus according to claim 1 wherein the supports are further concave.

3. The apparatus according to claim 1 wherein the supports are further straight.

* * * * *